US011666155B2

(12) United States Patent
Elengical et al.

(10) Patent No.: US 11,666,155 B2
(45) Date of Patent: Jun. 6, 2023

(54) BED COMPONENT AND BED

(71) Applicant: Emma Sleep GmbH, Frankfurt am Main (DE)

(72) Inventors: John Elengical, Frankfurt am Main (DE); Andreas Ebbecke, Frankfurt am Main (DE); Nick Kanzler, Frankfurt am Main (DE); Peter Kersten, Frankfurt am Main (DE); Fabian Laasch, Frankfurt am Main (DE); Thomas Weber, Frankfurt am Main (DE)

(73) Assignee: Emma Sleep GmbH, Frankfurt am Main (DE)

( * ) Notice: Subject to any disclaimer, the term of this patent is extended or adjusted under 35 U.S.C. 154(b) by 101 days.

(21) Appl. No.: 17/064,333

(22) Filed: Oct. 6, 2020

(65) Prior Publication Data

US 2021/0244195 A1 Aug. 12, 2021

(30) Foreign Application Priority Data

Sep. 11, 2019 (DE) ..... 10 2019 124 452.8

(51) Int. Cl.

| | |
|---|---|
| ***A47C 27/08*** | (2006.01) |
| ***A47C 27/10*** | (2006.01) |
| ***A47C 27/18*** | (2006.01) |
| ***A61G 7/057*** | (2006.01) |

(52) U.S. Cl.

CPC ..... *A47C 27/083* (2013.01); *A47C 27/082* (2013.01); *A47C 27/10* (2013.01); *A61G 7/05753* (2013.01); *A47C 27/18* (2013.01)

(58) Field of Classification Search

CPC ... A47C 27/083; A47C 27/082; A47C 27/081; A47C 27/08; A47C 27/14; A47C 27/18; A61G 7/05769; A61G 7/05776; A61G 7/05733; A61G 7/05753

USPC ..... 5/713, 710, 709, 706, 655.9, 740, 953

See application file for complete search history.

(56) References Cited

U.S. PATENT DOCUMENTS

| | | | | |
|---|---|---|---|---|
| 4,625,348 A | | 12/1986 | Renggli et al. | |
| 4,989,283 A | * | 2/1991 | Krouskop | A47C 27/083 5/713 |
| 5,249,319 A | * | 10/1993 | Higgs | A47C 27/18 5/713 |
| 5,509,154 A | * | 4/1996 | Shafer | A47C 31/008 318/16 |

(Continued)

FOREIGN PATENT DOCUMENTS

| | | |
|---|---|---|
| DE | 3400804 A1 | 7/1985 |
| DE | 60203729 T2 | 3/2006 |

(Continued)

*Primary Examiner* — Robert G Santos

(74) *Attorney, Agent, or Firm* — Dilworth IP, LLC

(57) ABSTRACT

A bed component, for example a mattress or a mattress base, includes a vacuum pump and at least one actuator which is adaptable in its height and/or firmness and has a maximum height in the non-actuated state, wherein the vacuum pump is fluidly connected to the actuator and a vacuum is formed in the actuator by the vacuum pump in the actuated state of the actuator and the height and/or firmness of the actuator is reduced, wherein the vacuum pump is provided in an area of the bed component external to the actuator. Further, a bed including a bed component is shown.

17 Claims, 7 Drawing Sheets

(56) References Cited

U.S. PATENT DOCUMENTS 5,652,484 A * 7/1997 Shafer ..... A47C 27/10 318/16
5,716,199 A * 2/1998 Shan-Chieh ..... A47C 27/082 417/313
5,903,941 A * 5/1999 Shafer ..... A47C 27/082 5/713
6,037,723 A * 3/2000 Shafer ..... A47C 27/10 5/713
6,483,264 B1 * 11/2002 Shafer ..... F04D 27/004 318/16
6,684,433 B2 2/2004 Giori et al.
7,475,440 B2 * 1/2009 Chaffee ..... A47C 27/083 137/614.19
8,225,444 B2 * 7/2012 Chaffee ..... A47C 27/082 5/713
8,826,478 B2 * 9/2014 Chaffee ..... F16K 15/202 5/713
9,345,335 B2 5/2016 Giori et al.
11,178,976 B2 * 11/2021 Adams ..... A61G 7/05792
2002/0124319 A1 * 9/2002 Giori ..... A47C 27/084 5/709
2002/0138911 A1 * 10/2002 Giori ..... A47C 27/084 5/709
2002/0148045 A1 10/2002 Giori et al.
2004/0168256 A1 * 9/2004 Chaffee ..... A47C 27/083 5/713
2009/0144903 A1 6/2009 Delvaux et al.
2009/0300846 A1 * 12/2009 Chaffee ..... A47C 27/082 5/710
2013/0074274 A1 * 3/2013 Chaffee ..... A47C 27/083 5/706
2016/0242562 A1 8/2016 Karschnik et al.
2016/0255966 A1 9/2016 Thomas
2016/0367039 A1 * 12/2016 Young ..... A47C 27/083
2017/0266070 A1 9/2017 Bobey et al.
2021/0244194 A1 * 8/2021 Adams ..... A47C 27/18
2021/0244195 A1 * 8/2021 Elengical ..... A47C 27/083

FOREIGN PATENT DOCUMENTS

DE 102019124452 A1 * 3/2021 ..... A47C 27/082
EP 3791756 A1 * 3/2021 ..... A47C 27/082
WO 8602244 A1 4/1986
WO 2018156971 A1 8/2018

* cited by examiner

BED COMPONENT AND BED

FIELD OF THE DISCLOSURE

The disclosure relates to a bed component, in particular a mattress or a mattress base, and a bed comprising a bed component.

BACKGROUND

Bed components for beds are known which enable an active and automatic adjustment of the height of the bed component and/or the firmness felt by a user of the bed component at least in several zones of a lying surface.

The automatic adjustment also partly occurs while a user is sleeping, for example, if the user changes position while sleeping, thus creating another lying profile.

To adjust the height and/or the firmness, bed components comprising actuators are known, for example air cushions, which are inflated actively in order to adjust a height and/or a firmness.

To this end, relatively high pressure that requires the use of linear or eccentric pumps, for example, is necessary. Pumps like these are however disadvantageous as they vibrate strongly and are loud. This is particularly disadvantageous if the adjustment occurs while the user moves during sleep.

For this reason, pumps are usually designed as external systems, thereby making the bed components however bulky. The external systems are also visible which is not perceived as attractive by the user.

SUMMARY

Thus, there is the need to provide a bed component that ensures optimal lying comfort with the minimal generation of noise.

For this purpose a bed component is provided, in particular a mattress or a mattress base, comprising a vacuum pump and at least one actuator which is adaptable in its height and/or firmness and has a maximum height in the non-actuated state, wherein the vacuum pump is fluidly connected to the actuator and a vacuum is formed in the actuator by the vacuum pump in the actuated state of the actuator and the height and/or firmness of the actuator is reduced, wherein the vacuum pump is provided in an area of the bed component external to the actuator.

The reduced height and/or firmness is reduced compared to the non-actuated state; that means a state in which there is no vacuum in the actuator.

The use of a vacuum pump for a bed component is advantageous as vacuum pumps generate significantly less disturbing noises and vibrations as pumps that generate overpressure. The system including pneumatic lines can thus be integrated into a mattress or into a mattress base. As a result, the engineering is not perceptible to the user and the bed component functions like a regular mattress or a regular mattress base.

Furthermore, good lying comfort is still ensured in the event of pump failure, for example during a power outage, as the actuator has a maximum height in the non-actuated state and can thus support the user during sleep well. Thus, the actuator acts as a conventional mattress or mattress base in the event of a failure or any other damage. In contrast, actuators with air cushions sink into themselves in the event of pump failure and provide considerably worse lying comfort in the non-actuated state.

Moreover, as the vacuum pump is provided in an area of the bed component external to the actuator, noise caused by the vacuum pump is attenuated at least to a certain extent by the bed component itself.

The bed component can be a mattress base, an entire mattress, a slatted frame or even a multi-piece device that cannot be integrated completely into a mattress. In the latter case, the vacuum pump can be provided, for example, for storage under and/or outside the bed on the floor.

The actuator has preferably a level support surface on the side facing towards the user. If a vacuum is present in the actuator, the support surface is lowered uniformly. In this way, the lying profile of the bed component can be adapted in a particularly targeted manner.

In the non-actuated state, the actuator is preferably flush with a remaining support surface of the bed component. The support surface can be a support surface for the user, thus a lying surface, or a topper for a mattress.

In this regard, at least one section of the lying surface or the support surface for the mattress can be formed by the actuator, wherein the lying surface or the support surface is lowered in the area of the actuator in the actuated state compared to the non-actuated state.

The actuator is for example a right parallelepiped.

The mattress or the mattress base can be subdivided into active and passive zones as a result of the actuators. Active zones are provided, for example, in the region of the shoulders and/or in the region of the hips, as the profile of a user lying down changes significantly in side view in these regions, for example when turning over during sleep, and as adjusting the support ensures improved lying comfort. In contrast, passive zones can be provided in the region of the legs or in the region of the head as adjusting the support in these regions is not required for optimal lying comfort. The bed component can be relatively economical as a result of the subdivision into active and passive zones as an actuator is only provided in the regions in which the support for the user can be noticeably improved, whereas an actuator can be foregone in the remaining regions.

According to an embodiment, the actuator comprises an open-pore, compressible core that is enclosed by an airtight enclosure. In particular, the compressible core is formed by foamed plastic.

As the compressible core is open pore, a uniform vacuum can be generated in the actuator which makes uniform lowering possible. The airtight enclosure ensures compression can be achieved by applying a vacuum.

A spring interior can be used instead of a foamed plastic core.

A pneumatic connection may be provided in the enclosure for connecting the actuator to the vacuum pump. This makes it possible to assemble the bed component particularly simply. In particular, the connection is also airtight.

According to an embodiment, an air duct extends in the actuator, in particular starting from the pneumatic connection. The air duct comprises, for example, a tube with a perforation. In this way, the pressure in the actuator can be reduced during actuation of the actuator as uniformly as possible, thereby also lowering of the support surface uniformly. In particular, this prevents one side of the actuator from being initially lowered more during the extraction of the air from the actuator before a uniform pressure is established once more in the actuator.

To be able to actuate the actuator particularly effectively and to set the optimal lying profile quickly, the actuator can have at least one restricting means that allows a deformation of the actuator in a height direction and prevents deformations in the length and width directions. In this regard, the height direction relates to the installed state of the actuator in the bed component.

Thus, the vacuum can be used solely for lowering the support surface. In other words, an isotropic compression is limited to a directed compression, in particular to a usable compression.

According to an embodiment, said at least one restricting means can comprise as least a frame that surrounds the actuator in a plane parallel to the lying surface.

The frame serves as a lateral stabilizing frame. This means that the frame can clamp the actuator in a plane perpendicular to the vertical axis of the actuator, thus preventing the actuator, in particular the foamed plastic core, from being compressed in this plane, whereas a compression is possible in the height direction.

Preferably, the frame is attached, for example sewn or adhered, to the airtight enclosure.

Alternatively or additionally, said at least one restricting means can comprise at least two rigid plates that are each arranged on an upper side and a bottom side of the actuator. The plates also ensure that the actuator is not compressed or only compressed slightly in a plane traverse to the height direction.

To additionally improve the quality of the user's sleep, a sound insulation device is provided for attenuating the sound generated by the vacuum pump.

The sound insulation device comprises, in particular, passive sound-insulation means, thereby making the bed component particularly energy efficient.

According to an embodiment, the sound insulation device comprises a housing in which the vacuum pump is located, wherein the housing comprises a sound-insulating wall. Such sound that propagates peripherally starting from the vacuum pump can be attenuated by means of such a housing.

For example, the housing can be a plastic housing with sound proofing made of foamed plastic.

Alternatively or additionally, the sound insulation device can comprise at least one silencer box that is integrated into the flow path between the actuator and the vacuum pump and/or is located on the outlet side of the vacuum pump. Such sound propagating in the pneumatic lines of the system can be attenuated by such a silencer box. Thus, such a silencer box prevents sound as much as possible from being transmitted through the pneumatic lines of the system to the user.

The silencer box can be provided inside or outside the housing.

It is also conceivable that the vacuum pump has a silencer on its outlet side.

The silencer box can comprise an acoustic labyrinth with concentric flow channels, in particular wherein the flow channels are concentric. Compared to straight-line acoustic labyrinths, a very compact design can be achieved by means of the concentric configuration.

Alternatively or in addition to the acoustic labyrinth, the silencer box can comprise an insulating material. To this end, the insulating material is preferably present in the flow channels of the silencer box.

The flow channels of the silencer box are arranged in particular in such a way that the pressure loss is minor. This contributes to the efficiency of the system.

A connection of the vacuum pump or of the actuator on the silencer box is preferably located in the centre of the silencer box, in particular in the centre of the acoustic labyrinth. As a result, the flow path has a maximum length through the silencer box so that the sound is attenuated as strongly as possible. One end of a flow path through the silencer box is located in particular at the centre of the silencer box.

The respective other connection on the silencer box is preferably located laterally on the silencer box, in particular on the opposite end of the flow path.

According to an embodiment, the silencer box is a cross-talk silencer ("Telefonieschalldämpfer"). By means of a cross-talk silencer, propagation of airborne and solid-borne sound can be attenuated effectively in a channel or line arrangement.

Moreover, the bed component can comprise a measuring system for measuring a change in the height of the actuator, wherein the measuring system is configured to measure the change in height directly or indirectly. Such a measuring system ensures that a desired change in the height of the actuator is actually achieved. The setting of the height and/or the firmness of the actuator, in particular the support surface, thus occurs particularly precisely.

The measuring system for direct measurement comprises, for example, at least one sensor, in particular a distance sensor. A distance sensor makes it possible to measure a change in height particularly precisely. To this end, the sensor can be integrated into the actuator.

The measuring system for indirect measurement can comprise a flow sensor and/or a pressure sensor. By means of a flow sensor, it is possible to determine how much air flows out of or into the actuator and thus determine a change in the height of the actuator. In other words, a travel distance can be determined from the evacuated volume. By means of a pressure sensor, the change in height can be measured in the evacuated actuator via the measurement of the static pressure, in particular the pressure differential to the environment, and the change in height, for example, can be derived using a characteristic curve.

The accuracy of the indirect measurement is greatly improved by the use of at least one restricting means as the movement occurs then in an extremely directed manner.

The accuracy of the lowering measurement is significantly greater in the case of direct measurement; however, it requires a sealed cable bushing through the airtight enclosure. In contrast, a sensor for indirect measurement can be located external to the actuator so that additional sealing measures do not need to be taken.

A reversal of movement is thus achieved by opening a connection between the at least partially evacuated actuator and the ambient air. A valve can be provided for this purpose.

The restoring force of the compressed actuator, in particular the foamed plastic, generates the necessary pressure difference to make it possible for the ambient air to flow in.

The object is also solved according to the disclosure by means of a bed comprising a bed component that is designed as previously described.

The bed can have a mattress. In this case, the mattress rests on the bed component. Alternatively, the bed component itself can be a mattress. In this case, the bed component rests on a bedstead or a slatted frame.

BRIEF DESCRIPTION OF THE DRAWINGS

Additional advantages and features can be found in the following description and in the attached drawings to which reference is made. In the drawings.

DETAILED DESCRIPTION

Lists having a plurality of alternatives connected by "and/or", for example "A, B and/or C" are to be understood to disclose an arbitrary combination of the alternatives, i.e. the lists are to be read as "A and/or B and/or C". The same holds true for listings with more than two items.

Figure 1:
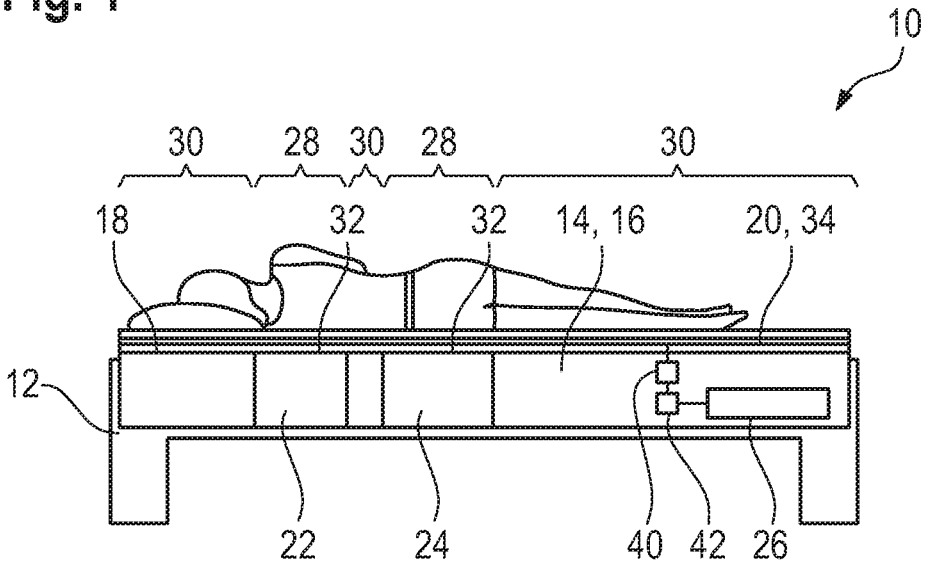
FIG. 1 shows a bed according to the disclosure comprising a bed component according to the disclosure in a first embodiment.

FIG. 1 shows a bed 10 according to the disclosure which comprises a bedstead 12, a bed component 14 located in the bedstead 12, a sensor mat 34, an evaluation unit 40 and a control unit 42.

In the shown embodiment, the bed component 14 is a mattress base 16 with a support surface 18, on which a mattress topper 20 rests.

Alternatively, the bed component 14 itself can already form a complete mattress with a lying surface that rests on the bed 10 or on a slatted frame.

Moreover, the bed component 14 can also be a slatted frame on which a conventional mattress can rest.

It is also conceivable that the bed component 14 is a multi-piece device that cannot be integrated into a mattress completely. In this regard, the vacuum pump 26 can be provided, for example, for storage under or outside the bed 10 on the floor.

In FIG. 1, the bed 10 is shown with a user lying on the bed 10, whereby the user is lying in a lateral position. In this position, the user's shoulders and the hips press more strongly into the mattress as in a supine position, which in certain circumstances can negatively affect the sleeping comfort.

The bed component 14 according to the disclosure is provided with adaptable actuators 22, 24 and a vacuum pump 26 in order to optimise the user's sleeping comfort.

The support surface 18 of the bed component 14 is subdivided into different zones by the actuators 22, 24, in particular into active zones 28 and into passive zones 30, wherein the actuators 22, 24 form the active zones 28.

The vacuum pump 26 is provided in an area of the bed component 14 external to the actuators 22, 24. In other words, the vacuum pump 26 is embedded in a passive zone 30 in the bed component 14. As a result, the sound emanating from the vacuum pump 26 is attenuated by the bed component 14 itself.

Preferably, the vacuum pump 26 is located at the foot end of the bed component 14 in order to position the sound source as far away as possible from the user's head.

The actuators 22, 24 are fluidly connected with the vacuum pump 26 that can actuate the actuators 22, 24 individually and/or collectively, thus making it possible to adjust the firmness and/or the height of the actuators 22, 24.

The lying properties of the bed 10 can be adapted by adjusting the height and/or the firmness of the actuators 22, 24 so that the user is always lying down as comfortably as possible.

For example, an actuator 22 is provided in the shoulder region and a second actuator 24 is provided in the hip region.

The actuators 22, 24 have a maximum height in a non-actuated state, as shown in FIG. 1. To this end, a respective support surface 32 of the actuators 22, 24 that is directed towards the user is flush with the remaining support surface 18 of the bed component 14.

Figure 2:
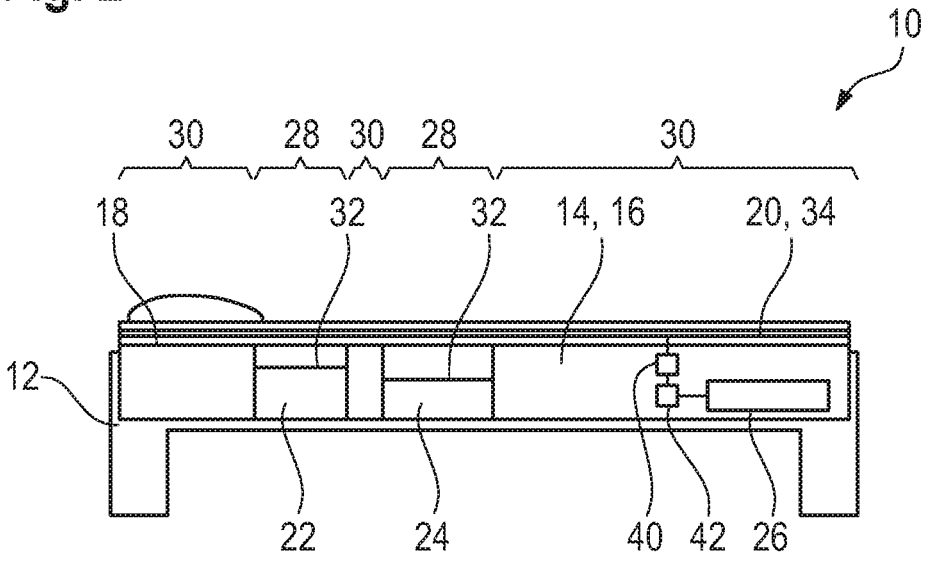
FIG. 2 shows the bed from FIG. 1 with amended lying properties.
Figure 3:
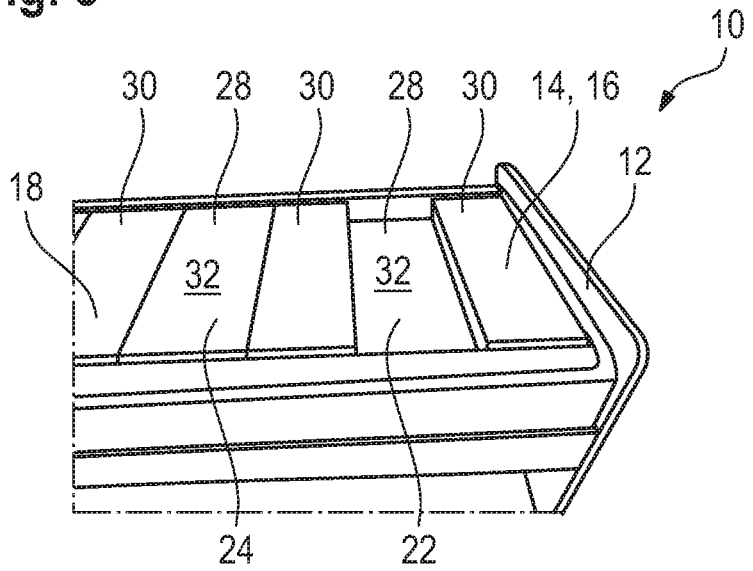
FIG. 3 shows the bed from FIGS. 1 and 2 in a perspective view from above.

In the FIGS. 2 and 3, the bed 10 is shown in a state in which the actuators 22, 24 are actuated compared to the state shown in FIG. 1. This means that the height of at least one actuator 22, 24 is reduced in each case so that the support surface 32 of the actuators 22, 24 is lowered. Alternatively, the firmness of the actuators 22, 24 can be changed so that there is in another lying sensation for a user.

The actuators 22, 24 can then be actuated when the user is asleep and has moved while sleeping. This means that the lying properties are adjusted constantly to the user's current lying position during the sleep phase. This ensures that the user sleeps particularly deeply and restoratively.

The respective lying position or a change to the user's lying position is detected by means of the sensor mat 34.

The sensor mat 34 rests, for example, as a topper on the bed component 14. The sensor mat 34 can form in particular the mattress topper.

Figure 4:
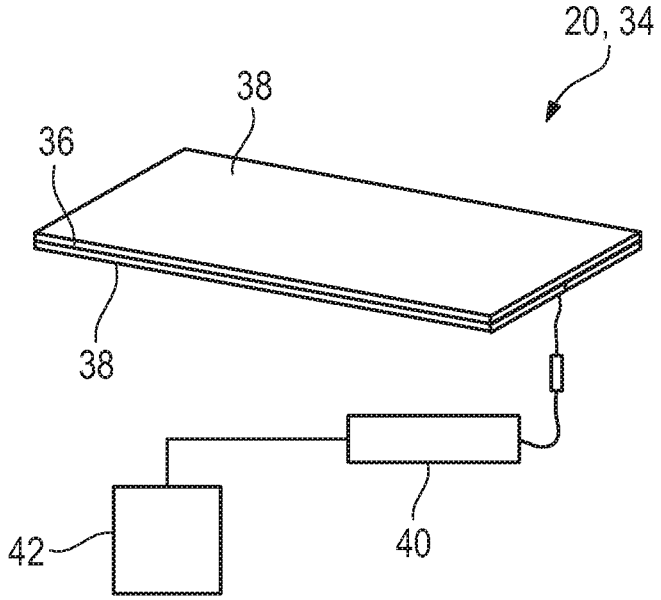
FIG. 4 shows a sensor mat for use with the bed according to FIGS. 1 and 2.

The sensor mat 34 shown in detail in FIG. 4 comprises a pressure sensor layer 36 and two padding layers 38, between which the pressure sensor layer 36 is located. t The pressure sensor layer 36 can have a large-area matrix comprising a plurality of pressure measuring cells that are read by the evaluation unit 40. The evaluation unit 40 then determines the user's lying position based on the measured values of the pressure measuring cells and the detected pressure profile. This can occur, for example, using a trained artificial neural network of the evaluation unit 40.

The information on the lying position is then sent by the evaluation unit 40 to the control unit 42.

The control unit 42 is configured to activate the vacuum pump 26, thereby enabling the control unit 42 to control and set the height and/or firmness of the actuators 22, 24.

The setting of the height and/or the firmness of the actuators 22, 24 occurs in particular automatically by means of the control unit 42 using the lying position and pressure profile transmitted by the evaluation unit 40 as the user cannot undertake any manual adjustments while sleeping.

Figure 5:
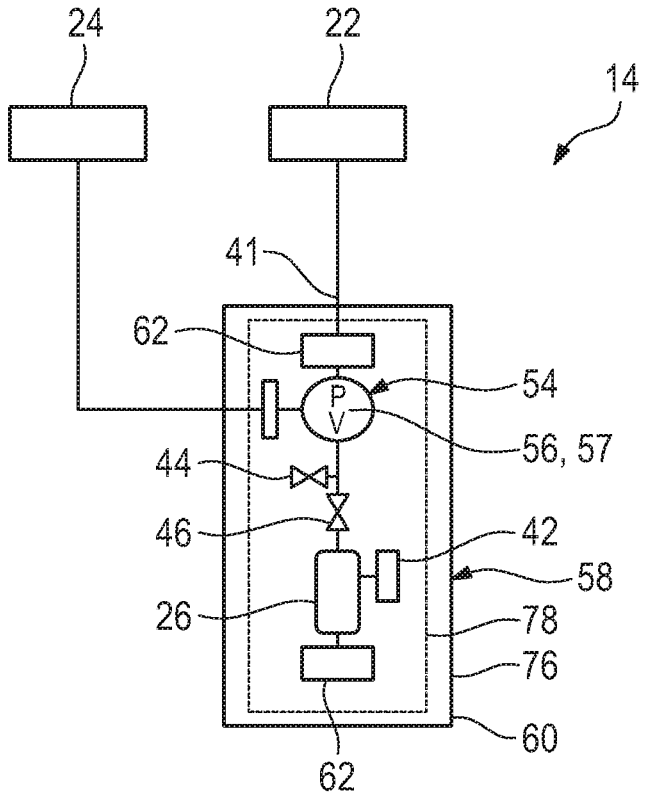
FIG. 5 shows a schematic detailed view of the bed component according to FIG. 1.

FIG. 5 shows a diagram for the purpose of illustrating the design and mode of operation of the bed component 14 according to a first embodiment.

In addition to the actuators 22, 24 and the vacuum pump 26, the bed component 14 comprises a pneumatic line 41 with valves 44, 46, a measuring system 54 and a sound insulation device 58.

The actuators 22, 24 are connected to the vacuum pump 26 via the pneumatic line 41.

The valves 44, 46 are located in the pneumatic line 41. These are used for regulating the supply and extraction of air to and from the actuators 22, 24. Additional valves can be provided in such a way as to operate several actuators separately from each other with only one vacuum pump 26.

The measuring system 54 and the control unit 42, are used for measuring and controlling the change in height of the actuator 22, respectively.

For this purpose, the measuring system 54 comprises a pressure sensor 56 that can measure static pressure in the system. It is possible to determine a change in height of the actuator 22, 24 indirectly by using the static pressure measured by the pressure sensor 56 or a pressure differential to the environment.

Alternatively, a flow sensor 57 can be provided instead of a pressure sensor 56 that allows indirect conclusions to be drawn on the change in height of the actuator 22, 24 based on an amount of air measured.

The sound insulation device 58 is used for attenuating noises generated by the vacuum pump 26.

For this purpose, the sound insulation device 58 comprises a housing 60 with a sound-insulating wall and at least one silencer box 62, the vacuum pump 26 being accommodated in said housing 60.

In addition to the vacuum pump 26, the silencer boxes 62, the pneumatic lines 41, the valves 44, 46 and the control unit 42 are also accommodated in the housing 60 of the sound insulation device 58 and the bed component 14.

In the shown embodiment, the sound-insulating housing 60 is formed by a plastic wall 76 which is lined on its interior wall with a soundproofing material 78, for example a foamed plastic.

In the shown embodiment, three silencer boxes 62 are provided. The silencer boxes 62 are cross-talk silencers, for example, or they are designed as described in FIGS. 8 to 10.

One of the silencer boxes 62 is located in the flow path between the actuator 22, 24 and the vacuum pump 26, in particular on the housing 60.

Another one of the silencer boxes 62 is located on the outlet side of the vacuum pump 26. To this end, the silencer or the silencer box 62 can be designed differently on the outlet side as the silencers or the silencer boxes 62 in the flow path between the actuator 22, 24 and the vacuum pump 26.

Figure 8:
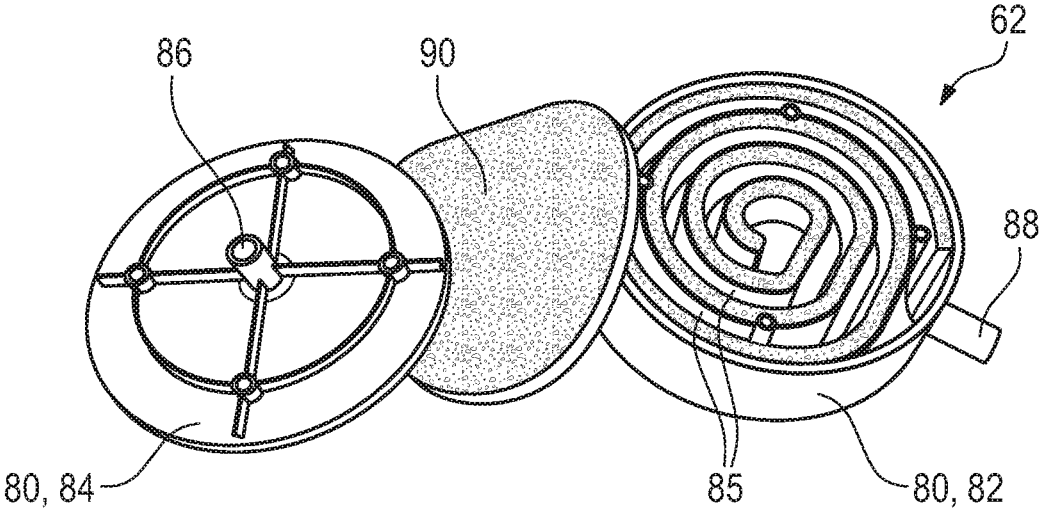
FIG. 8 shows a silencer box of the bed component according to FIG. 1 in the opened state.
Figure 9:
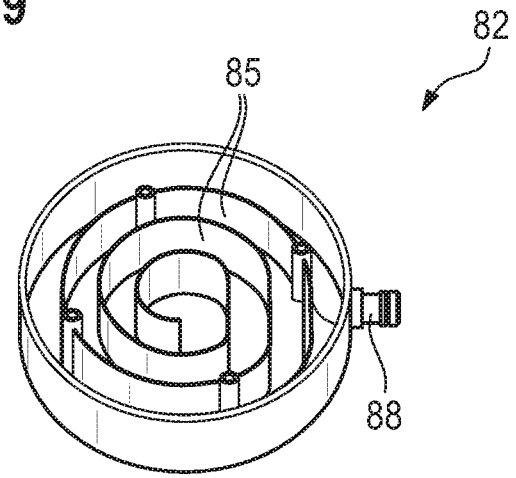
FIG. 9 shows a bottom part of the silencer box from FIG. 8.
Figure 10:
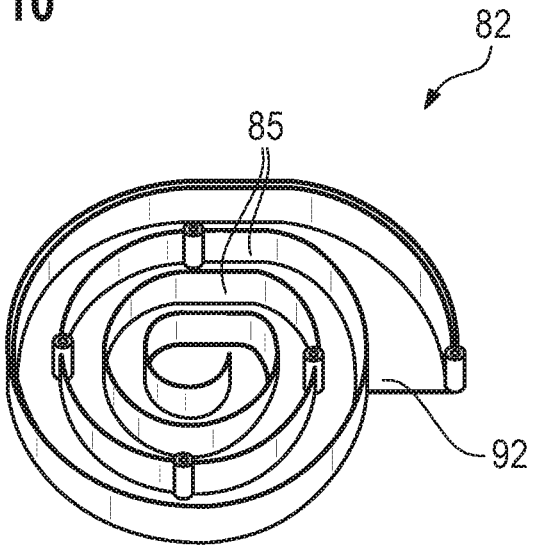
FIG. 10 shows a bottom part of another silencer box of the bed component according to FIG. 1.

In particular, the silencer boxes 62 that are located in the flow path between the actuator 22, 24 and the vacuum pump 26 are cross-talk silencers and/or are designed as described in FIGS. 8 to 10.

The design and mode of operation of the actuators 22, 24 are explained in more detail in the following in relation to the FIGS. 6 and 7.

Figure 6:
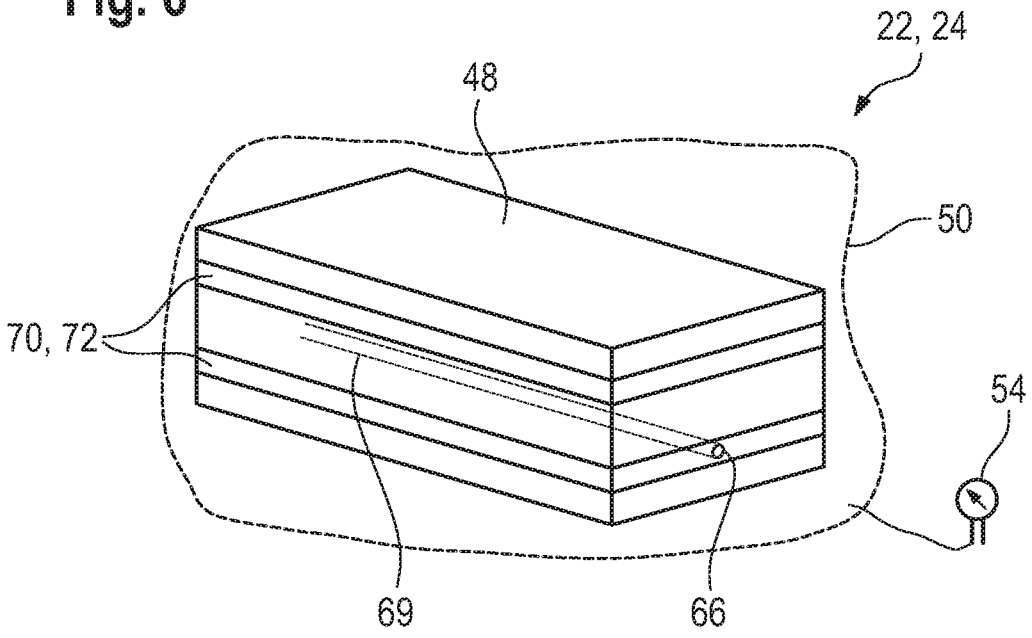
FIG. 6 shows an actuator of the bed component according to FIG. 1 in a schematic view.
Figure 7:
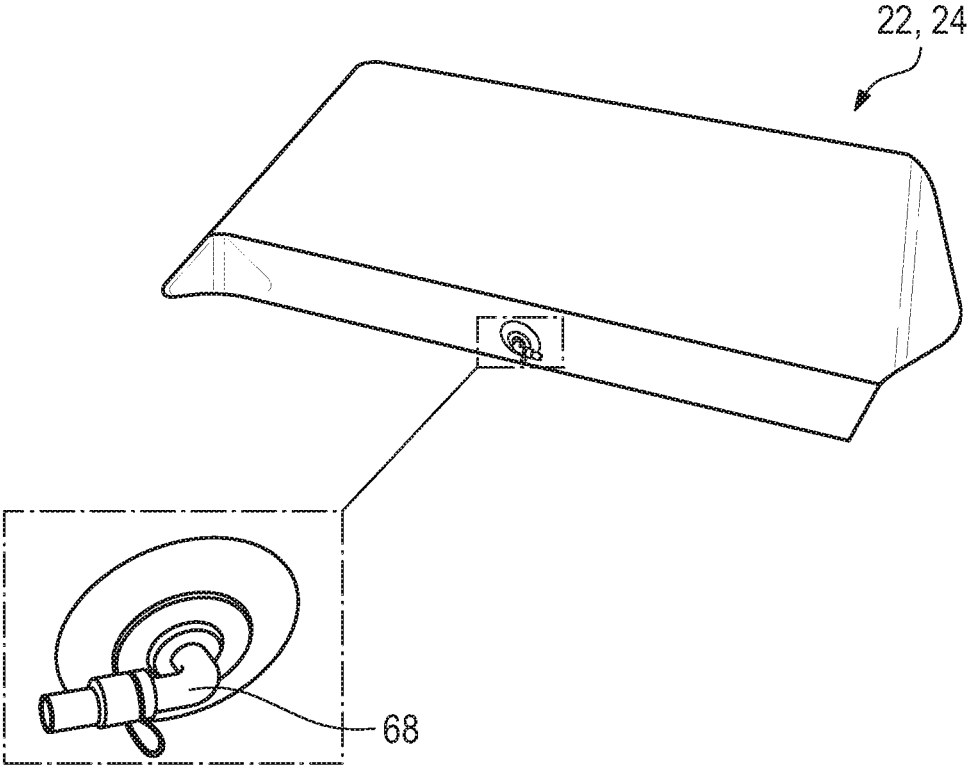
FIG. 7 shows the actuator according to FIG. 6 in a perspective view.

FIG. 6 shows one of the actuators 22, 24 of the bed component 14 according to a first embodiment. FIG. 7 shows the actuator 22, 24 from FIG. 6 in an external perspective view.

The actuator 22, 24 comprises a core 48, an enclosure 50 and several restricting means 70.

The material of the core 48 is compressible and open pore, for example a foamed plastic. In particular, the core 48 is a right parallelepiped.

The core 48 is enclosed by an airtight enclosure 50, wherein the enclosure 50 is only shown schematically for simplicity and to make the core 48 more visible. The enclosure 50 can itself be thermally fused. Thus, the core 48 is located is a space sealed in an airtight manner that is limited by the enclosure 50.

A pneumatic connection 66 may be provided in the enclosure 50 for connecting the actuator 22, 24 to the vacuum pump 26. A connector 68 (see FIG. 7) can be located on the connection 66.

Starting from the pneumatic connection 66, an air duct 69 extends in the actuator 22, 24, said air duct 69 being preferably formed by a perforated tube. The air duct 69 makes it possible for the air to be extracted from the actuator 22, 24 uniformly so that the support surface 32 of the actuator 22, 24 can be lowered uniformly. The air duct 69 is however optional.

In the embodiment shown in FIG. 6, the restricting means 70 are formed by two frames 72 that each surround the core 48 in a plane parallel to the lying surface, in particular laterally.

The frames 72 can rest on the core 48, in particular on the circumferential surface of the core 48.

In this regard, the frames 72 are located below the enclosure 50, thus within the enclosure 50. Hence, the frames 72 clamp the enclosure 50 in the length and width directions and as a result prevents the enclosure 50 from contracting in the length and width directions.

Alternatively, the frames can also be located outside the enclosure 50 and attached, for example sewn or adhered, to the enclosure 50 fixedly.

The actuation of the actuator 22, 24, thus a change in the height and/or the firmness of the actuator 22, 24 is controlled by means of the control unit 42. In particular, the control unit 42 regulates the supply or extraction of air to or from the actuator 22, 24 based on the user's lying position detected by the sensor mat 34 in order to regulate the pressure within the actuator 22, 24, more specifically within the enclosure 50.

In this regard, the state in which the pressure within the enclosure 50 corresponds to the ambient pressure is the non-actuated state (cf. FIG. 1). In this non-actuated state, the core 48 and thus the actuator 22, 24 is expanded as large as possible. For example, the core 48 is not compressed in the non-actuated state.

To reduce the height of the actuator 22, 24 and to change the firmness, a vacuum is generated in the actuator 22, 24, more specifically in the enclosure 50, by means of the vacuum pump 26.

As a result, the open-pore core 48 is compressed, in particular owing to the fact that the enclosure 50, which is contracted as a result of to the vacuum, exerts pressure on the core 48 and compresses it.

The restricting means 70 only allow a deformation of the core 48 in the height direction and prevent deformations in the length and width directions owing to the rigidity of the frames 72. The restricting means 70 are thus used to limit the deformation of the core 48 to a directed deformation.

The actuator 22, 24 is now in an actuated state in which its height is reduced and its firmness is changed in comparison to the non-actuated state (cf. FIG. 2).

The actuator 22, 24 itself is firmer by reducing the height of the actuator 22, 24 as the material of the actuator 22, 24 is compressed. The perceived firmness for the user is reduced however in this case as a user can continue to sink into the lying surface.

An increase in the height starting from an actuated state of the actuator 22, 24 is achieved by opening the valve 44 for the air supply and making it possible for the air to flow into the enclosure 50 as a result of the vacuum prevailing in the enclosure 50. Moreover, the compressed core 48 generates a force for increasing the actuator 22, 24 as the core 48 is elastic.

Thus, the vacuum pump 26 does not need to be operated to increase the height of the actuator 22, 24 or to transfer the actuator 22, 24 into the non-actuated state.

In this way, the bed component 14 can be adapted to the user's lying position at any time and automatically.

To this end, the sound insulation device 58 reduces the acoustic emission in order to not disturb the user or indeed wake the user up.

The mode of operation of the sound insulation device is explained in more detail in the following in relation to FIGS. 8 to 10.

The FIGS. 8 and 9 show the design of such a silencer box 62 in more detail.

The silencer box 62 has a two-piece housing 80 consisting of a body 82 and a cover 84.

An acoustic labyrinth is designed in the body 82, for example, through a concentric, spiral flow channel 85.

The inlet connection opens into the centre of the acoustic labyrinth, i.e. the inlet connection 86 is located in the centre of the base of the body 82 or the cover 84.

The outlet connection 88 of the silencer box 62 is located on a lateral wall of the body 82 and opens into the end of the acoustic labyrinth distal from the centre.

Thus, the sound must pass through the entire labyrinth before it reaches the outlet connection 88 and is attenuated along the way.

The inlet connection 86 is designed on the cover 84 in the embodiment shown in FIG. 8. However, it can also be designed in the body 82.

Similarly, the outlet connection 88 can be located in the centre of the acoustic labyrinth and the inlet connection 86 on the lateral wall of the body 82.

The silencer box 62 can also be lined with an insulating material 90, in particular with an open-pore insulating material 90. Noise can thus be attenuated more efficiently.

FIG. 10 shows the body 82 of another embodiment of the silencer box 62. The cover 84 is not shown for simplicity.

Instead of an outlet connection 88, the body 82 shown in FIG. 10 has an outlet opening 92 that is located at the end of the acoustic labyrinth. As previously described, the inlet connection 86 not shown is located in the centre of the labyrinth.

This silencer box 62 is particularly suitable for placement on an outlet side of the vacuum pump 26. In this regard, only one inlet connection 86 is required on the silencer box 62, the air can simply flow outwards at the end of the acoustic labyrinth.

Figure 11:
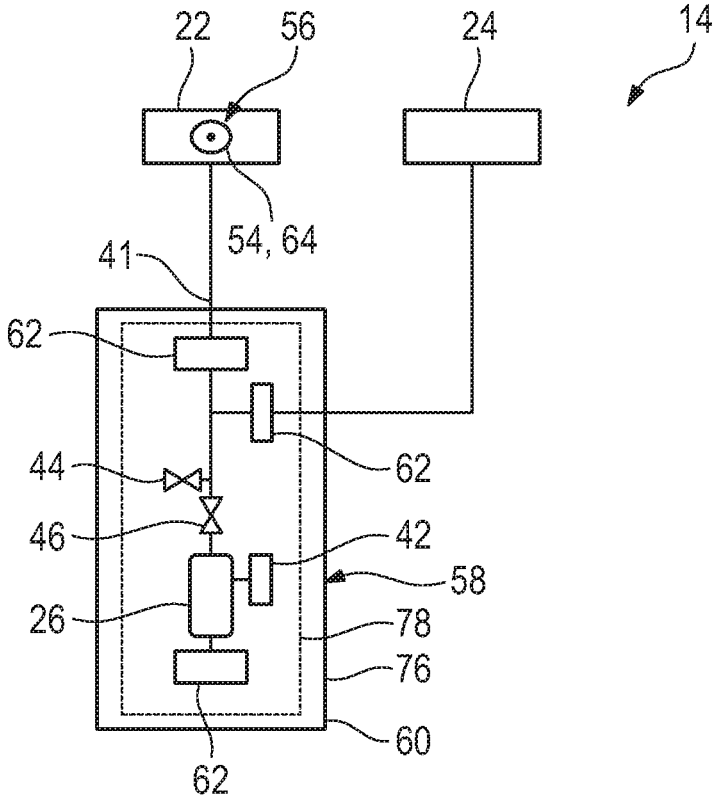
FIG. 11 shows a schematic detailed view of a second embodiment of a bed component according to the disclosure.
Figure 12:
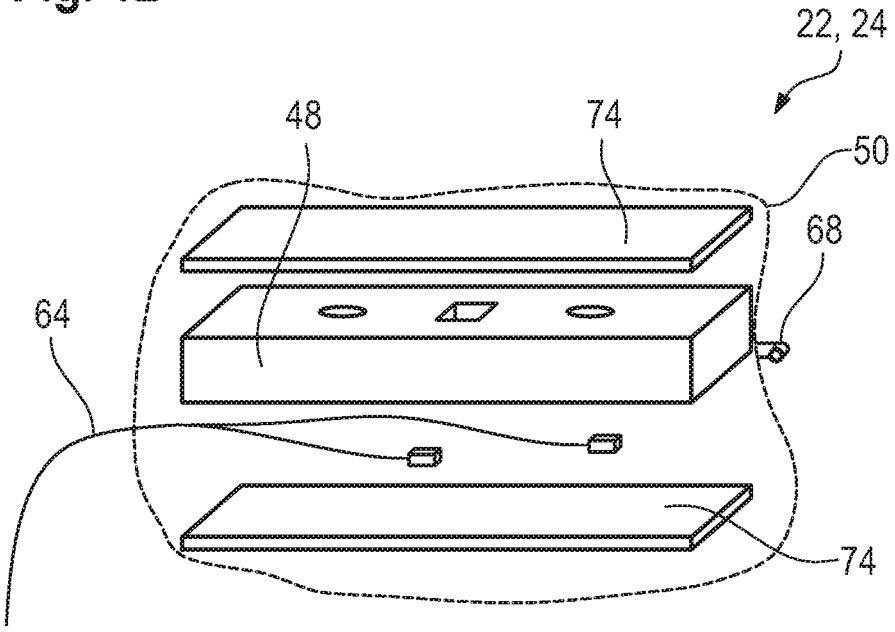
FIG. 12 shows an actuator of the bed component according to FIG. 11 in an exploded view.

A further embodiment of the bed component 14 is shown schematically in FIGS. 11 and 12. The bed component 14 according to this embodiment substantially corresponds to the embodiment previously described so that only the differences are discussed hereinafter. Identical and functionally equivalent parts are provided with the same reference signs. The difference between both embodiments is merely the type of measuring system 54 and the design of the restricting means 70.

The restricting means 70 of the actuator 22, 24 of the second embodiment comprise two rigid plates 74. The plates 74 rest on the upper side or the bottom side of the core 48 and are located, for example, within the enclosure 50.

The plates 74 prevent non-uniform deformation of the core 48 and thus result in a controlled deformation in the height direction.

Alternatively or additionally, the plates 74 can be provided in the frames 72.

The measuring system 54 of the actuator 22, 24 according to the further embodiment comprises at least a distance sensor 64, in the shown example two distance sensors 64.

The distance sensors 64 are provided within the enclosure 50 as can be seen in FIG. 12.

In the shown embodiment, the core 48 therefore comprises two horizontal openings, in which a distance sensor is provided in each case.

The openings extend in particular from the upper side of the core 48 to the bottom side of the core 48.

Of course, it is also conceivable that only one distance sensor 64 and one opening are provided which are located in the middle of the respective actuator 22, 24.

For example, the distance sensors 64 are optical sensors that can determine the distance between the enclosure 50 or the plates 74 on the upper side and the bottom side of the core 48. Using the distance measured, the actual height of the actuator can then be determined directly so that the distance sensors 64 make a direct measurement of the height of the actuators 22, 24 possible.

By means of the distance sensor 64, a change in height of the actuator 22, 24 can also be measured directly.

Figure 13:
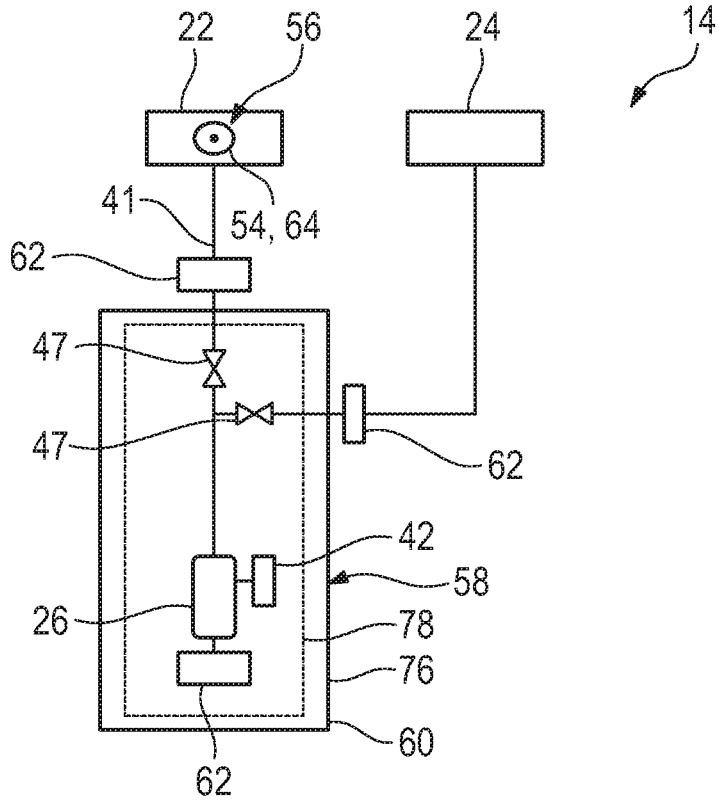
FIG. 13 shows a schematic detailed view of a third embodiment of a bed component according to the disclosure.

A third embodiment of the bed component 14 is shown schematically in FIG. 13. The bed component 14 according to this embodiment substantially corresponds to the embodiment described in FIGS. 11 and 12, in particular regarding the measuring system 54 and the restricting means 70 so that only the differences are discussed hereinafter. Identical and functionally equivalent parts are provided with the same reference signs.

Other valves or another arrangement of valves are provided in the embodiment according to FIG. 13.

For example, the valve 44 for the air supply that was present in the previous embodiment is integrated into the vacuum pump 26 or is replaced by the vacuum pump 26 in the third embodiment.

The functions of the valves 44, 46 of the previous embodiments are replaced by a valve 47 between the vacuum pump 26 on the one hand and the actuators 22, 24 on the other hand, wherein it also depends on the operating state of the vacuum pump 26 as to whether the air flows into or out of the actuators 22, 24.

In the third embodiment, two valves 47 are provided that are each allocated to one of the actuators 22, 24 and can only block the flow path between the vacuum pump 26 and the actuator 22 or 24 allocated to them. As a result, the actuators 22, 24 are regulated separately from each other.

In the event that only one valve 47 is to be used, it can be provided in the shared flow path between the vacuum pump 26 and the actuators 22, 24, for example at the location of the valve 46 of the previous embodiments.

Moreover, the silencer boxes 62 located between the actuators 22, 24 and the vacuum pump 26 are provided outside the housing 60 in the third embodiment.

The silencer or the silencer box 62 that is located on the outlet side of the vacuum pump 26 can be designed differently than the silencer or the silencer box 62 in the flow path between the actuator 22, 24 and the vacuum pump 26.

In particular, the silencer boxes 62 that are located in the flow path between the actuator 22, 24 and the vacuum pump 26 are cross-talk silencers and/or are designed as described in FIGS. 8 to 10.

Of course, different features of the example embodiments discussed can be combined with each other as desired.

The invention claimed is:

1. A bed component, comprising a vacuum pump and at least one actuator which is adaptable in at least one of its height and its firmness and has a maximum height in a non-actuated state, wherein the vacuum pump is fluidly connected to the at least one actuator and a vacuum is formed in the at least one actuator by the vacuum pump in the actuated state of the at least one actuator and the at least one of height and firmness of the at least one actuator is reduced, wherein the vacuum pump is provided in an area of the bed component external to the at least one actuator, wherein the at least one actuator has at least one restricting means that allows a deformation of the at least one actuator in a height direction and prevents a deformation in length and width directions, wherein said at least one restricting means comprises at least two rigid plates that are each arranged on an upper side and a bottom side of the at least one actuator.

2. The bed component according to claim 1, wherein the bed component is a mattress or a mattress base.

3. The bed component according to claim 1, wherein the at least one actuator comprises an open-pore, compressible core that is enclosed by an airtight enclosure.

4. The bed component according to claim 3, wherein a pneumatic connection is provided in the enclosure for connecting the at least one actuator to the vacuum pump.

5. The bed component according to claim 3, wherein an air duct extends in the at least one actuator.

6. The bed component according to claim 1, wherein said at least one restricting means comprises at least a frame which surrounds the at least one actuator in a plane parallel to a lying surface.

7. The bed component according to claim 1, wherein a sound insulation device is provided for attenuating the sound generated by the vacuum pump.

8. The bed component according to claim 7, wherein the sound insulation device comprises a housing, in which the vacuum pump is located, wherein the housing comprises a sound-insulating wall.

9. The bed component according to claim 8, wherein the sound insulation device comprises at least one silencer box that is at least one of integrated into a flow path between the at least one actuator and the vacuum pump and is located on an outlet side of the vacuum pump.

10. The bed component according to claim 9, wherein the at least one silencer box comprises an acoustic labyrinth with concentric flow channels.

11. The bed component according to claim 9, wherein a connection of the vacuum pump or of the at least one actuator on the at least one silencer box is located in a center of the at least one silencer box.

12. The bed component according to claim 9, wherein the at least one silencer box is a cross-talk silencer.

13. The bed component according to claim 1, wherein the bed component comprises a measuring system for measuring a change in the height of the at least one actuator, wherein the measuring system is configured to measure the change in height directly or indirectly.

14. The bed component according to claim 13, wherein the measuring system for direct measurement comprises at least one sensor.

15. The bed component according to claim 14, wherein the at least one sensor is a distance sensor.

16. The bed component according to claim 13, wherein the measuring system for indirect measurement comprises at least one of a flow sensor and a pressure sensor.

17. A bed comprising a bed component, wherein the bed component comprises a vacuum pump and at least one actuator which is adaptable in at least one of its height and its firmness and has a maximum height in a non-actuated state, wherein the vacuum pump is fluidly connected to the at least one actuator and a vacuum is formed in the at least one actuator by the vacuum pump in the actuated state of the at least one actuator and the at least one of height and firmness of the at least one actuator is reduced, wherein the vacuum pump is provided in an area of the bed component external to the at least one actuator, wherein the at least one actuator has at least one restricting means that allows a deformation of the at least one actuator in a height direction and prevents a deformation in length and width directions, wherein said at least one restricting means comprises at least two rigid plates that are each arranged on an upper side and a bottom side of the at least one actuator.

* * * * *